United States Patent [19]

Tagaki

[11] 4,455,912

[45] Jun. 26, 1984

[54] KEYBOARD MUSICAL INSTRUMENT

[75] Inventor: Shinji Tagaki, Hamamatsu, Japan

[73] Assignee: Kabushiki Kaisha Kawai Gakki Seisakusho, Shizuoka, Japan

[21] Appl. No.: 342,887

[22] Filed: Jan. 26, 1982

[30] Foreign Application Priority Data

Jan. 29, 1981 [JP] Japan ..... 56-10209[U]

[51] Int. Cl.[3] ..... G10C 3/02

[52] U.S. Cl. ..... 84/177; 84/352; 84/DIG. 17

[58] Field of Search ..... 84/174–177, 84/352, 354, 431–432, 470 R, DIG. 3, DIG. 17

[56] References Cited

U.S. PATENT DOCUMENTS 2,494,700 1/1950 Gage ..... 84/177 X 2,949,053 8/1960 Andersen .

2,974,555 3/1961 Andersen .

3,695,138 10/1972 Andersen ..... 84/470 R 3,750,516 8/1973 Olson ..... 84/470 R

*Primary Examiner*—Lawrence R. Franklin

*Attorney, Agent, or Firm*—Armstrong, Nikaido, Marmelstein & Kubovcik

[57] ABSTRACT

A keyboard musical instrument is provided which comprises a main body which has a playing position and an upright position and first and second legs which are positioned on the front and rear of the main body for supporting the main body in the playing position. A hinge device connects the main body and the first legs such that the main body is pivoted about the hinge means for moving the main body between the playing position and the upright position.

8 Claims, 12 Drawing Figures

KEYBOARD MUSICAL INSTRUMENT

BACKGROUND OF THE INVENTION

1. Field of the Invention

This invention relates to a keyboard musical instrument such as an electric piano, for instance, which is easy to transport.

2. Description of the Prior Art

A prior art horizontal type musical instrument of the type shown in FIG. 1 is considerably large in weight so that the weight thereof, as well as the size thereof, becomes a problem when the musical instrument is to be transported. In this respect, in a keyboard musical instrument of this type, there has been hitherto proposed a type as shown in FIG. 2, in which a main body a of the musical instrument is so constructed as to be separable into a first case a-1 having a string arranged frame and a second case a-2 loaded with a keyboard and an operating mechanism. Accordingly, when this type of instrument is to be transported, it is disassembled into the first case a-1 and the second case a-2. The second case a-2 is then turned upside down as shown in FIG. 3 and, thereafter, each of the four legs are removed by unscrewing a coupling c fixed to keyboard bed b, and a strut pipe f of each leg which is fixed to the board b by a common central screw e. The separate parts are then transported directly by hand or in a carrier casing having casters. After the transportation thereof, the parts are re-assembled in the reverse order. This type of musical instrument, accordingly, is inconvenient in that the first case a-1 and the second case a-2 are still heavy and at least two persons are required for transporting or re-assembling the instrument. Further, it is difficult and time consuming.

SUMMARY OF THE INVENTION

It is the primary object of the present invention to provide a keyboard musical instrument in which the main body thereof can be easily turned from a horizontal playing position to a vertical, upright position for transportation and storage.

It is another object of the present invention to provide a keyboard musical instrument in which the main body is mounted on at least one set of legs by a hinge means and the body can be moved between horizontal and upright positions by turning the body about the hinge means.

The present invention is directed to a musical instrument of a type having a main body supported horizontally by at least one first leg and at least one second leg which are disposed on one side and on the other side thereof. It is characterized in that one of the first legs and second legs and the main body thereof are interconnected through a hinge means so that the main body may be turned about the hinge means to be in an upright position supported by the legs.

DETAILED DESCRIPTION OF THE PREFERRED EMBODIMENT

Figure 4:
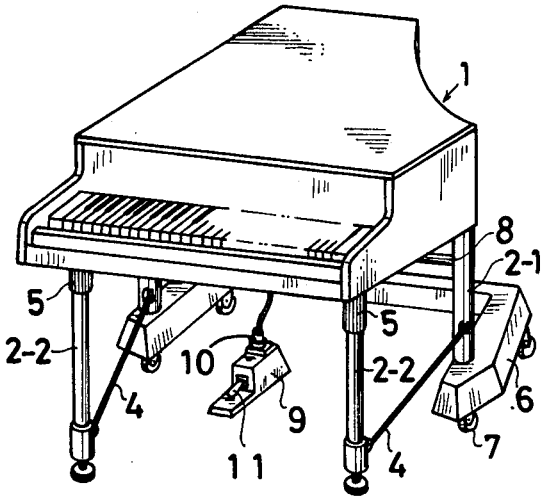
FIG. 4 is a perspective view of the preferred embodiment of a keyboard musical instrument of the present invention.
Figure 5:
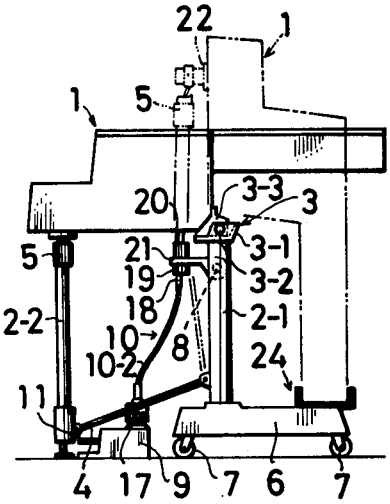
FIG. 5 is a side view thereof.
Figure 6:
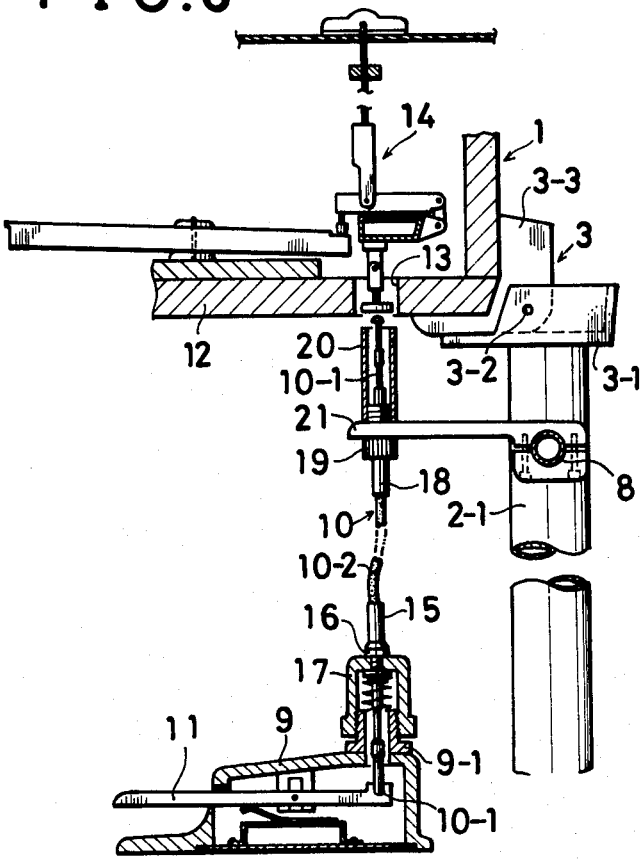
FIG. 6 is a sectional side view thereof showing the relation between a pedal mechanism and a main body of the musical instrument.

Referring to FIGS. 4 to 6, a main body 1 of a horizontal type musical instrument is supported horizontally by at least one first leg 2-1 and at least one second leg 2-2, which are disposed on each side thereof. For example, a pair of right and left first legs 2-1,2-1 are provided on the rear side and a pair of right and left second legs 2-2,2-2 are provided on the front side. Each first leg 2-1 and the main body 1 are interconnected through a hinge means 3 so that the main body 1 may be turned thereabout to be in an upright position with the upright main body being supported by the first legs 2-1.

A leg base 6 for the rear side first legs 2-1,2-1 has casters 7 on its lower surface and the hinge means 3 comprises a hinge base 3-1 fixed to the upper end of each first leg 2-1 and a hinge member 3-3, which is pivotally connected to the hinge base 3-1 through a pivot shaft 3-2 and is fixed to the rear and lower surface corner portion of the main body 1. A reinforcing lateral stay pipe 8 is connected between the two first legs 2-1,2-1. A pedal containing box 9 has a flexible wire 10 extending therefrom, and the lower end of a core wire 10-1 is detachably connected to a pedal 11 provided in the pedal containing box 9. The upper end portion of the core wire 10-1 is positioned to pass through a hole 13 to engage and disengage an operating mechanism 14 provided on the main body 1. An outer tube 10-2 of the flexible wire 10 has, at one end thereof, a metal fitting 15, a bushing 16 and an adjusting nut 17, with the adjusting nut 17 being in threaded engagement with a threaded tubular part 9-1 of the pedal containing box 9. The upper end of the outer tube 10-2 has a threaded member 19 which is in threaded engagement with a metal fitting 18 attached thereto and is passed through a stationary member 21 so as to be in threaded engagement with a threaded tube 20. Thus the upper end is fastened to the stationary member 21, which is fixed at its other end to the reinforcing lateral stay pipe 8 by clamping the stationary member thereto.

Each of the second legs 2-2, that is, the front legs, is pivotally attached by a second coupling member 22-2 through a pivot shaft 23 to a first coupling member 22-1 fixed to the keyboard bed 12 of the main body 1. A tubular locking member 5 having a thread 5-1 cut in the inner surface thereof is slidably mounted thereon as shown in FIGS. 7A, 7B and 7C.

Figure 7A:
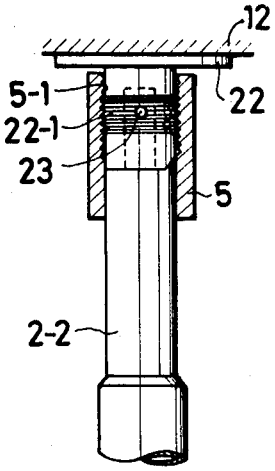
FIGS. 7A and 7B are sectional side views of a portion of a second leg showing two use conditions thereof.
Figure 7B:
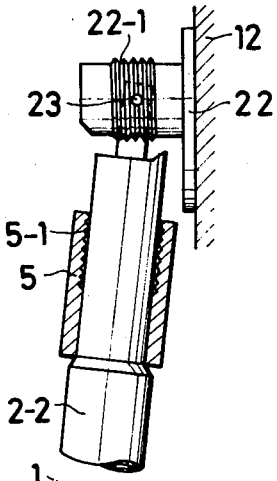
Figure 7C:
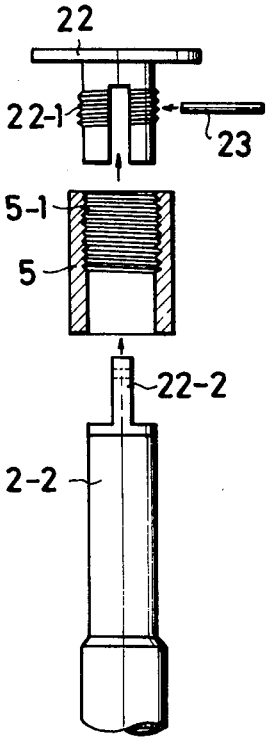
FIG. 7C is an exploded side view of the same.

Accordingly, when the musical instrument is set in its horizontal use position as shown in FIG. 4, the second leg 2-2 is turned from the condition shown in FIG. 7B so as to be aligned with the axis of the coupling 22-1 as shown in FIG. 7A. Then the tubular member 5 is moved upwards and turned so that the inner thread 5-1 thereof may be brought into engagement with an outer thread of the coupling 22-1.

Figure 8:
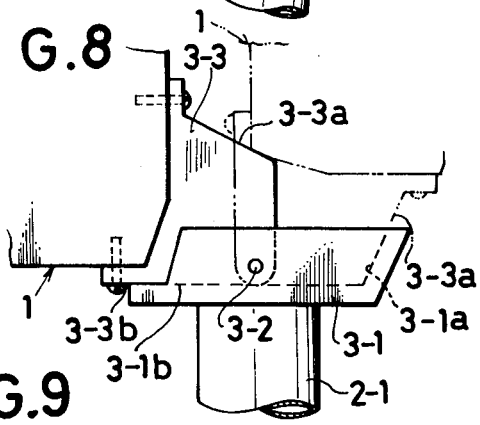
FIG. 8 is a side view of a hinge means with a first leg and the main body.

When the musical instrument set horizontally as shown in FIG. 4 is to be transported, the tubular member 5 is fixedly positioned on the upper end portion of the second leg 2-2, that is, the front leg is turned to release the engagement between the threads 5-1 and the threads of coupling member 22-1. Next, the front portion of the main body 1 of the musical instrument is lifted upwards, and thereby the main body 1 is turned about the hinge means 3,3 of the upper end portions of the first or rear legs 2-1,2-1, thereby positioning the body 1 in an upright or vertical posture as shown by the broken lines in FIGS. 5 and 8. If the main body 1 is in its upright position, the surface 3-3*a* of the hinge member 3-3 attached to the main body 1 contacts the inner inclined surface 3-1*a* of the hinge base 3-1 and, at that time, the turning movement of the main body 1 is stopped. When the musical instrument in the upright posture is set in its horizontal posture, the upright main body 1 is turned toward the left in the drawings; that is, in the reverse direction. Consequently, the surface 3-3*b* of the hinge member 3-3 strikes against the horizontal surface 3-1*b* of the hinge base 3-1, resulting in stopping the turning movement thereof.

If the main body 1 is positioned into its upright position, the second leg 2-2 is moved to a laying position in relation to the upright main body 1 owing to its own weight, and if the main body 1 is positioned in its horizontal position, the second leg 2-2 is stopped in a standing position in relation to the horizontal main body 1 by the strut means 4.

Figure 9:
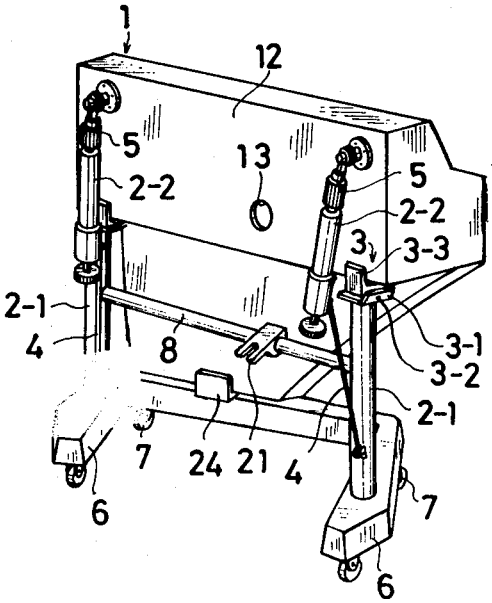
FIG. 9 is a perspective view of the musical instrument with the main body being in its upright position.

Referring to FIG. 9, a stopper 24 prevents the main body 1 from turning from its upright position. FIG. 9 shows the musical instrument with the main body 1 thereof in its upright position and pedal-containing box 9 and the flexible wire 10 having been detached from the stationary member 21 after releasing the threaded engagement with the threaded members 19,20.

Figure 1:
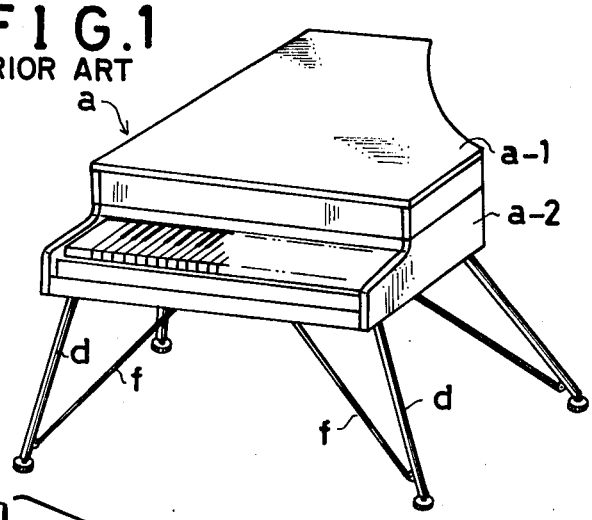
FIG.1 PRIOR ART
FIG. 1 is a perspective view of a conventional keyboard musical instrument.
Figure 2:
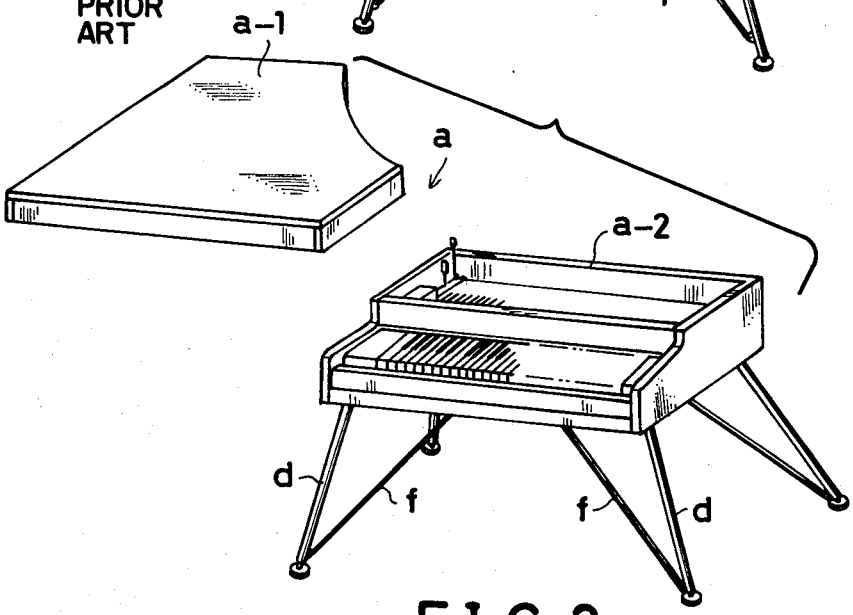
FIG.2 PRIOR ART
FIG. 2 is an exploded perspective view thereof.
Figure 3:
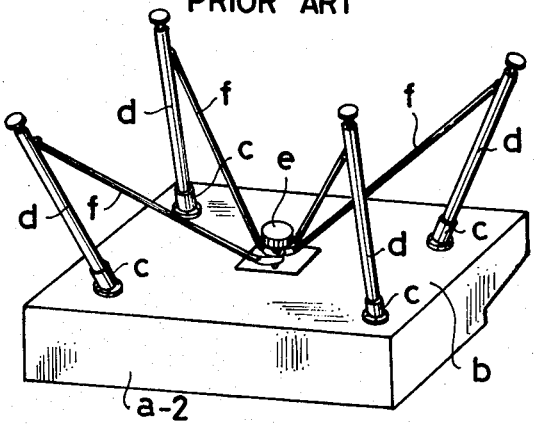
FIG.3 PRIOR ART
FIG. 3 is a perspective view thereof showing a casing containing a keyboard or the like which has been turned over.

In place of the second leg 2-2, it may be modified with a coupling (not shown) fixed on the keyboard bed and another type of leg attached thereto, which screws into the coupling in almost the same manner as shown in FIG. 3. Additionally, in the illustrated example, the main body 1 in its upright position is supported only by the first legs 2-1,2-1 but a modification can be made in which another supporting leg supports the upright main body 1 jointly with the first legs 2-1.

Figure 10:
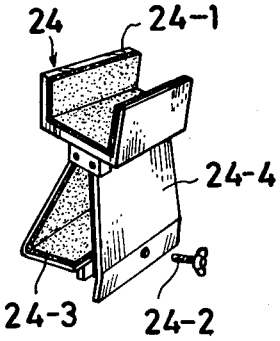
FIG. 10 is a perspective view of a stopper for stopping the turning of the main body.

FIG. 10 shows the stopper 24 for preventing the turning of the upright main body 1. The stopper 24 comprises a channel-shaped member 24-1 for holding the main body 1 therein and two plate members 24-3,24-4 turnably attached to the bottom surface thereof and arranged to firmly hold the leg base 6 between them through screw 24-2.

Thus, according to this invention, since one of the first leg and the second leg supporting the main body of a horizontal type musical instrument is connected to the main body through a hinge means, the main body may be turned thereabout to be brought in an upright position supported by the leg. The preparatory work for transportation, the transportation thereof and the setting up thereof can be carried out easily and in a short time by a single person. Additionally, the main body can be brought in its upright position when the musical instrument is not being used so that the musical instrument does not require a large space and can be placed in a corner of a stage or the like.

The present invention may be embodied in other specific forms without departing from the spirit or essential characteristics thereof. The presently disclosed embodiments are, therefore, to be considered in all respects as illustrative and not restrictive, the scope of the invention being indicated by the appended claims rather than the foregoing description and all changes which come within the meaning and range of equivalency of the claims are, therefore, to be embraced therein.

What is claimed:

1. A single keyboard musical instrument comprising:

(a) a single main body having a horizontal playing position and a vertical upright position;

(b) first and second leg means comprising respectively at least one rear leg and at least one front leg positioned on said main body for supporting said main body in said playing position, said first leg means further comprising a leg base extending horizontally from a lowermost portion of said at least one rear leg, and stopper means on said leg base spaced apart from said at least one rear leg for contacting said main body when said main body is in its upright position to maintain said body in said upright position; and (c) hinge means connecting said main body and said first leg means, said main body being pivoted about said hinge means for moving said main body between said playing position and said upright position.

2. A keyboard musical instrument as set forth in claim 1 including coupling means for coupling said second leg means to said main body such that when said main body is in said playing position, said second leg means extend substantially perpendicularly thereto and when said main body is in said upright position, said second leg means are positioned adjacent thereto.

3. A keyboard musical instrument as set forth in claim 2 wherein said coupling means comprises a first coupling member extending from said main body, a second coupling member fixed to said second leg means and pivotally connected to said first coupling member and locking means for preventing the pivoting of said first and second coupling members when said second leg means extend substantially perpendicularly from said main body.

4. A keyboard musical instrument as set forth in claim 3 wherein said fixing means is a tubular member slidably mounted on said second leg means.

5. A keyboard musical instrument as set forth in any one of claims 1, 2, 3 or 4 wherein said first leg means includes caster means on one end thereof opposite to the end coupled to said main body.

6. A keyboard musical instrument as set forth in claim 1, wherein said at least one front leg is pivotally connected at its top to said main body and strut means are provided between said at least one front leg and said at least one rear leg, said strut means being pivotally connected to each, whereby when said main body is in its playing position said strut means props said at least one front leg to support said main body and when said main body is in its upright position, said strut means draws said at least one front leg into a position approximately parallel to said main body.

7. A keyboard musical instrument as set forth in claim 1, wherein said first leg means comprises two vertically fixed legs and said leg base is substantially U-shaped having two horizontal leg portions and a center portion, said rear legs being mounted on ends of said leg portions and said stopper means being mounted on said center portion.

8. A keyboard musical instrument as set forth in claim 1, including means for connecting said second leg means to said main body comprising a first coupling member extending from said main body having threads thereon, a second coupling member fixed to said second leg means and pivotally connected to said first coupling member, and a tubular member slideably mounted on said second leg means and adapted to threadingly engage said first coupling member when said main body is in said playing position.

* * * * *